United States Patent [19]

Frey-Wigger

[11] Patent Number: 4,518,059

[45] Date of Patent: May 21, 1985

[54] ATTACHMENT FOR THE BOOMS OF CRANES OR THE LIKE

[76] Inventor: Paul Frey-Wigger, Am Zeigerwald, CH-6247 Schötz, Switzerland

[21] Appl. No.: 511,667

[22] Filed: Jul. 7, 1983

[30] Foreign Application Priority Data

Jul. 12, 1982 [CH] Switzerland ..... 4222/82

[51] Int. Cl.[3] ..... B66F 11/04

[52] U.S. Cl. ..... 182/2

[58] Field of Search ..... 182/2, 113, 152, 24, 182/163; 212/266

[56] References Cited

U.S. PATENT DOCUMENTS

| | | | |
|---|---|---|---|
| 2,049,353 | 7/1936 | Cary | 182/113 |
| 2,632,530 | 3/1953 | Wagner | 52/118 |
| 2,685,352 | 8/1954 | Hukari | 182/2 |
| 2,821,312 | 1/1958 | Wiegel | 182/2 |
| 3,610,367 | 10/1971 | Atchey | 182/2 |
| 3,963,095 | 6/1976 | Hedges | 182/2 |
| 4,090,585 | 5/1978 | Laub | 182/113 |
| 4,098,371 | 7/1978 | Cox | 182/2 |
| 4,179,010 | 12/1979 | Ashworth | 182/2 |
| 4,274,793 | 6/1981 | Frey-Wigger | 182/2 |
| 4,418,791 | 12/1983 | Frey-Wigger | 182/2 |

FOREIGN PATENT DOCUMENTS

| | | | |
|---|---|---|---|
| 473534 | 3/1929 | Fed. Rep. of Germany | 182/163 |
| 1440874 | 6/1976 | United Kingdom | 182/2 |
| 536280 | 12/1976 | U.S.S.R. | 182/2 |

*Primary Examiner*—Reinaldo P. Machado
*Attorney, Agent, or Firm*—Peter K. Kontler

[57] ABSTRACT

The free end portion of the boom of a crane is detachably coupled to a flat rectangular carrier for a collapsible gallery. The carrier can pivot about an axis which is normal to the longitudinal direction of the boom to and from a position adjacent to one side of the boom, and the collapsed gallery can be pivoted to a position outwardly adjacent to the carrier when the latter is adjacent to one side of the boom. This renders it possible to move the crane without detaching the carrier and the gallery from the boom. The flat sections of the gallery are collapsible into planes which are parallel to the pivot axis between the gallery and the carrier.

20 Claims, 11 Drawing Figures

ATTACHMENT FOR THE BOOMS OF CRANES OR THE LIKE

CROSS-REFERENCE TO RELATED CASES

The attachment of the present invention constitutes an improvement over and a further development of the attachment which is disclosed in the commonly owned copending patent application Ser. No. 247,835 filed Mar. 26, 1981, now abandoned. Other types of attachments are disclosed in commonly owned U.S. Pat. No. 4,274,793 granted June 23, 1981 and in the commonly owned copending patent application Ser. No. 247,754 filed Mar. 26, 1981, now U.S. Pat. No. 4,418,791 granted Dec. 6, 1983.

BACKGROUND OF THE INVENTION

The present invention relates to cranes and analogous machines in general, and more particularly to improvements in attachments for the booms of cranes or the like. Still more particularly, the invention relates to improvements in an attachment which can be separably or permanently coupled to the preferably extensible (variable-length) boom of a crane or an analogous machine and can carry one or more persons who are to perform work on the facades of tall buildings, at the undersides, along the sides or on other parts of bridges or viaducts, on tall chimneys, poles or masts, along the surfaces of rocks, cliffs or hills, and/or in analogous situations where the work must be performed at the hard-to-reach exposed sides of buildings or the like. A machine which is equipped with the attachment of the present invention can be used with equal advantage by fruit gatherers, firemen, policemen, shipyard workers, aircraft maintenance personnel and others.

It is well known to equip a crane with one or more elongated booms whose length can be increased or reduced (either mechanically or by fluid-operated means), which can be rotated about their respective axes, and/or whose inclination can be changed through an angle of up to or even in excess of 90 degrees (e.g., between a horizontal and a vertical position). Reference may be had to U.S. Pat. Nos. 2,632,530 to Wagner and 2,821,312 to Wiegel which disclose cranes or analogous machines with extensible and adjustable booms. The disclosures of these patents are incorporated herein by reference.

It is further known to attach to the free end portion of the boom of a crane a basket or another type of receptacle (hereinafter called gallery) for one or more persons and/or for cargo. As a rule, the gallery is suspended on a cable, chain, cord or an analogous flexible element which is trained over one or more pulleys at the free end of the boom. In many instances, the gallery comprises a substantially rectangular or square floor and four railings or walls which extend upwardly from and above the floor to enhance the safety of the person or persons occupying the gallery and/or to prevent the cargo from sliding off the floor in response to swaying of the gallery and/or in response to abrupt changes of inclination of the boom.

Many cranes are motorized so that they can be readily transferred between different locales of use and/or to or from the owner's or user's yard. Since the width of the gallery normally greatly exceeds the width of the boom, it is customary to detach the gallery from the end portion of the boom prior to driving the crane to the yard, from the yard, or from one locale of use to the next locale. This is a time-consuming operation, and the transport of the gallery normally involves the use of a discrete vehicle. Alternatively, the crane must be accompanied by a detachment of security personnel to ensure that the road is free and the gallery at the free end of the crane is capable of passing below bridges, overpasses or viaducts as well as that the moving crane, with the boom extended forwardly or folded rearwardly, can take the curves and bypass other types of obstacles. All this is very cumbersome and contributes significantly to the cost of using the crane.

OBJECTS AND SUMMARY OF THE INVENTION

An object of the invention is to provide a novel and improved attachment which can be used at the free end of the boom of a crane or an analogous machine to support a gallery in such a way that the gallery will take up a minimum of space during transport or during non-use of the machine.

Another object of the invention is to provide a novel and improved gallery for use in or with an attachment of the above outlined character.

A further object of the invention is to provide an attachment which can remain on the boom during transport of the machine to or from a locale of use or between different locales of use.

An additional object of the invention is to provide an attachment which can be converted into a compact unit when the machine and/or the gallery is not in use.

A further object of the invention is to provide a novel and improved method of collapsing a gallery at the free end of the boom forming part of a crane or an analogous machine.

Still another object of the invention is to provide an attachment whose constituents can be moved to and from positions in which they occupy space which does not contribute to the length and/or height of the machine so that the machine, with the attachment secured to the free end of its boom, can be transported with the attachment just as readily and just as safely as if the attachment were separated from the boom.

A further object of the invention is to provide a novel and improved connection between a gallery and the free end portion of the boom forming part of a crane or an analogous machine.

Another object of the invention is to provide an attachment which can be readily installed on the booms of existing cranes or analogous machines with a minimum of alterations and attendant expenditures for labor and material.

Still another object of the invention is to provide an attachment which is safer than heretofore known attachments with galleries suspended on the crane cable or a like flexible element.

The invention resides in the provision of an attachment for the end portion of an elongated boom in a crane or an analogous machine wherein the boom is preferably movable between a plurality of positions and/or can be caused to change its length. The attachment comprises a carrier having a first and a second end portion, means for coupling the first end portion of the carrier to the end portion of the boom so that the carrier is pivotable about a first axis, which is at least substantially normal to the longitudinal direction of the boom, to and from a predetermined position of at least substantial parallelism with and adjacent to one side of the boom, a collapsible gallery, and means for connecting the gallery to the second end portion of the carrier for pivotal movement about a second axis which is or can be at least substantially parallel to the first axis. If the boom is arranged to swivel in a substantially vertical plane, the first axis is preferably disposed in or is parallel with such vertical plane.

The collapsible gallery preferably comprises a plurality of substantially flat sections which are movable with reference to each other into a plurality of neighboring planes. The sections include a floor and a plurality of railings or walls which extend upwardly from the floor in the non-collapsed (i.e., erected) condition of the gallery. Such neighboring planes are preferably parallel to each other, and the collapsed gallery is pivotable about the second axis to a position in which the neighboring planes are at least substantially parallel to the longitudinal direction of the boom so that, on movement of the carrier to its predetermined position, the carrier and the collapsed gallery can be disposed adjacent to the one side of the boom. The neighboring planes are preferably parallel to the second axis.

In accordance with a presently preferred embodiment of the invention, the carrier comprises spaced-apart first and second components which are respectively adjacent to and extend in substantial parallelism with the first and second axes, and at least two substantially parallel elongated braces extending between the first and second components and having first and second end portions articulately connected with the respective components. Such carrier preferably further comprises adjusting means (e.g., at least one fluid-operated motor) for changing the inclination of at least one brace with attendant changes in the level of the gallery with reference to the free end portion of the boom. Such carrier can be said to constitute a parallel mechanism. It is further preferred to employ a pair of braces one of which is of adjustable length (e.g., it can comprise two or more tubes which are telescoped into each other) so that a change in the length of such one brace will entail a change in orientation of the second axis with reference to the first axis.

In accordance with one of the presently preferred embodiments, the gallery comprises a square or rectangular floor and four walls or railings which normally extend above the floor. These walls include a first wall, a second wall which is spaced apart from and is preferably parallel to the first wall in erected condition of the gallery, and third and fourth walls which are parallel to each other and extend between the first and second walls. Such third and fourth walls preferably extend at right angles to the first and second walls in erected condition of the gallery. The just described gallery preferably further comprises means for detachably fastening the third and fourth walls to one of the first and second walls so that the third and fourth walls can be pivoted against the other of the first and second walls upon detachment from the one wall. The floor of such gallery is preferably pivotable with reference to the walls to a position adjacent to the second wall so that the third and fourth walls of the collapsed gallery are preferably disposed between the floor and the first wall.

The novel features which are considered as characteristic of the invention are set forth in particular in the appended claims. The improved attachment itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
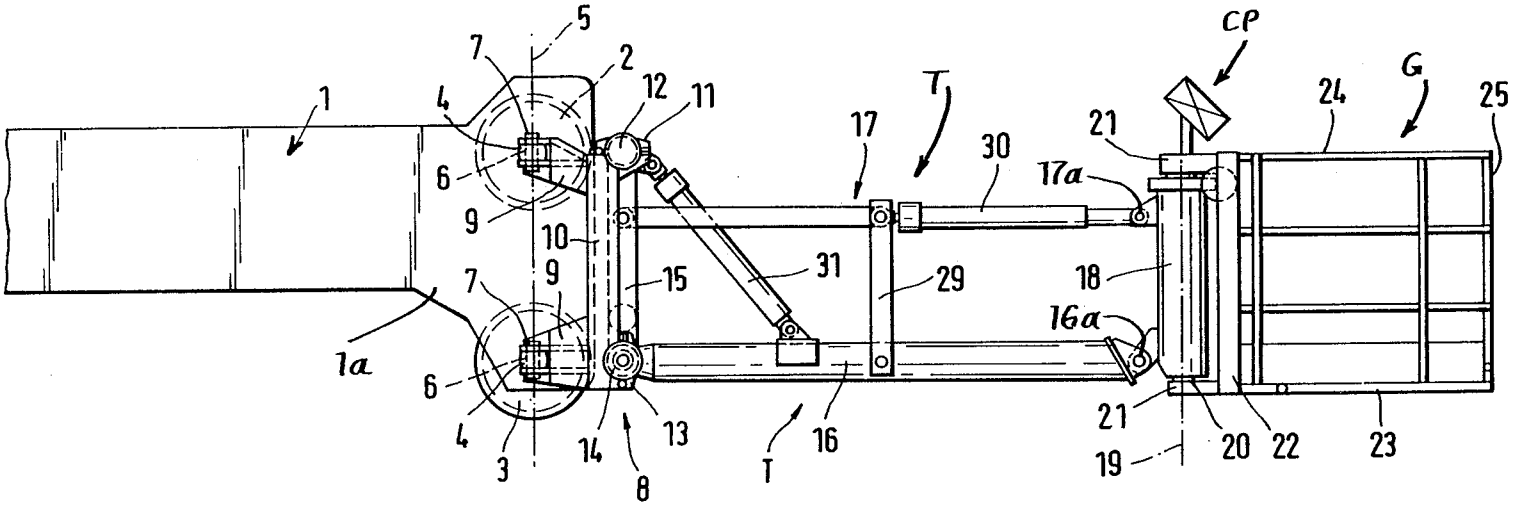
FIG 1 is a fragmentary side elevational view of a boom and of an attachment which embodies one form of the invention, the carrier of the attachment being shown in the general plane of the boom and the gallery being shown in erected condition.

Referring first to FIGS. 1 to 6, the reference character 1 denotes an elongated boom which forms part of a crane or an analogous machine and is assumed to be rotatable about a vertical axis as well as movable in a vertical plane, for example, in the plane of FIG. 1. The vertical axis about which the boom 1 can turn is disposed to the left of the structure shown in FIG. 1. The enlarged (right-hand) end portion 1*a* of the boom 1 is coupled to the adjacent end portion of an elongated carrier T which forms part of the improved attachment and can be caused to pivot about a vertical axis 5 which is parallel to the aforementioned vertical pivot axis for the boom and normal to the longitudinal direction of the boom. The manner in which the boom 1 can be mounted for pivotal movement in a vertical plane and for rotation about a vertical axis is disclosed, for example, in the aforementioned U.S. patents to Wagner and Wiegel to which reference may be had, if necessary. These patents further disclose the manner in which the length of the boom 1 can be increased or reduced. The end portion 1*a* of the boom 1 carries two pulleys 2 and 3 for a crane cable (not shown) which can be used for the hoisting of cargo into a collapsible gallery G which is coupled to the right-hand end portion of the carrier T. The machine which embodies the boom 1 is preferably mounted on wheels or is a track laying vehicle so that the boom can be readily transported to or from the owner's or user's yard or between different locales of use.

The horizontal shafts 4 for the pulleys 2 and 3 extend forwardly and rearwardly (as viewed in FIG. 1) beyond the respective pulleys and are flattened at their upper and lower sides. Such flattened portions are formed with aligned vertical bores or holes 6 for detachable coupling pins 7 (e.g., customary cotter pins).

Figure 2:
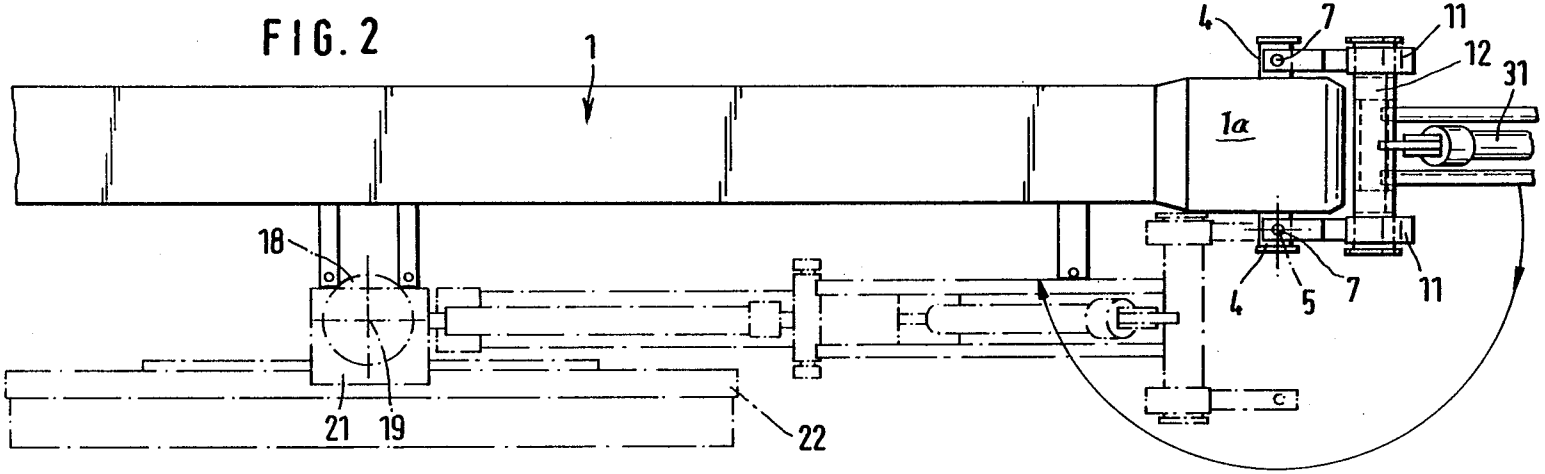
FIG. 2 is a plan view of the boom and of a portion of the attachment, the predetermined position of the carrier being shown by phantom lines the same as the gallery in collapsed condition adjacent to one side of the boom.
Figure 5:
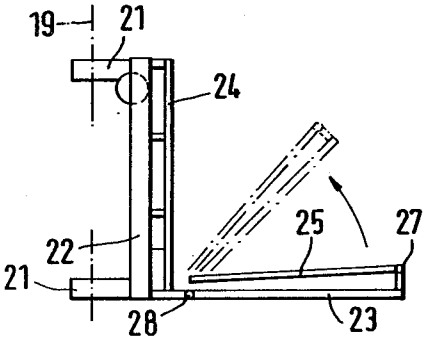
FIG. 5 is a similar side elevational view of the gallery but during a further stage of conversion into a small package.

The end portion 1*a* of the boom 1 comprises an adapter 8 including a tubular member 10 which is adjacent to and substantially parallel to the vertical axis 5 and is separably connected to a vertical first component 15 of the carrier T. The member 10 has a pair of preferably bifurcated upper arms 9 which straddle the respective flattened end portions of the upper horizontal shaft 4 and are detachably coupled thereto by the corresponding cotter pins 7. The member 10 further comprises a pair of preferably bifurcated lower arms 9 which straddle the flattened end portions of the lower shaft 4 and are detachably coupled thereto by the respective cotter pins 7. To this end, the arms 9 are provided with vertical bores or holes (not specifically referenced) for the corresponding cotter pins 7. If the pins 7 at the one or the other side of the carrier T are removed, the latter can be pivoted about the axis 5 (which is common to the remaining two cotter pins 7) from the extended position of FIG. 1 to a predetermined position which is shown in FIG. 2 by phantom lines and in FIG. 6 by solid lines and in which the carrier is adjacent to one side of the boom 1. Thus, the remaining two pins 7 can be said to constitute the pintles of two aligned hinges whose leaves are respectively constituted by the corresponding arms 9 of the member 10 and the corresponding flattened end portions of the two shafts 4. The pivotal movements of the carrier T can be likened to those of a door panel. It will be noted that the axis 5 is located at one side of the end portion 1*a* of the boom 1.

The upper end portion of the tubular member 10 further carries two pairs 11 of grippers or jaws, and one jaw of each pair 11 is pivotable between open and closed positions so as to respectively release or hold a horizontal crossbar 12 forming part of the left-hand component 15 of the carrier T. The jaws of each pair 11 are substantially semicircular and one jaw of each pair 11 can be rigidly affixed to the tubular member 10, i.e., it suffices if one of each pair of jaws is pivotable between open and closed positions as long as the jaws of each pair 11 can be parted sufficiently to permit insertion or removal of the respective end portion of the crossbar 12. For example, each lower jaw can be rigid with the member 10 and each upper jaw 11 is then pivotable to the extent which is needed to provide between the free end portions of the associated jaws a gap having a width at least slightly exceeding the diameter of the crossbar 12.

The lower end portion of the tubular member 10 is provided with two additional pairs 13 of jaws which are analogous to the upper jaws, i.e., one jaw of each pair 13 can be opened and closed to respectively release or hold the corresponding end portions of a lower crossbar 14 forming part of the component 15. The latter is a vertical tube which provides a rigid connection between the crossbars 12 ahd 14. The manner in which the movable jaws of each of the four pairs of jaws 11, 13 can be locked to the associated jaws in order to reliably couple the component 15 of the carrier T to the tubular member 10 of the adapter 8 at the end portion 1*a* of the boom 1 is not specifically shown in the drawing.

Figure 4:
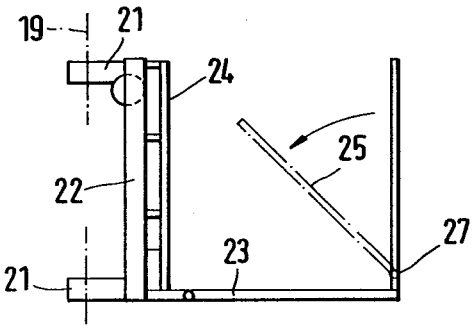
FIG. 4 is a side elevational view of the gallery in partly collapsed condition.
Figure 3:
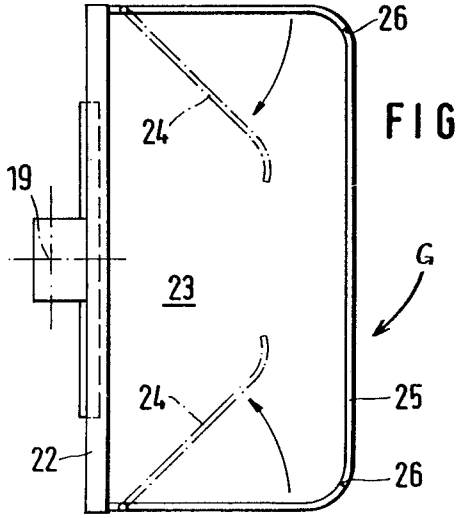
FIG. 3 is a plan view of the gallery in erected condition.
Figure 6:
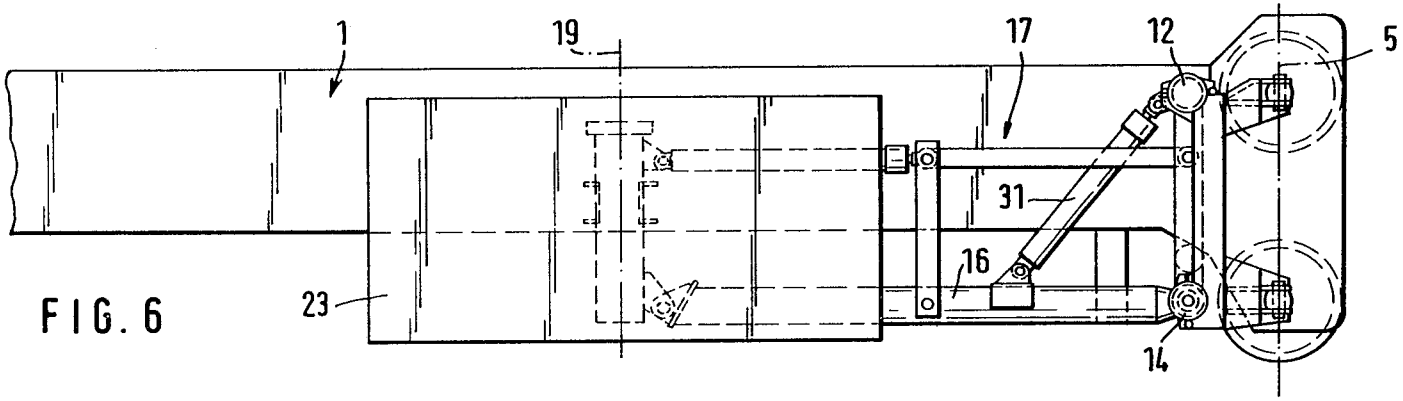
FIG. 6 is a side elevational view of the boom, with the carrier and the fully collapsed gallery shown at that side of the boom which faces the observer of FIG. 6.
Figure 7:
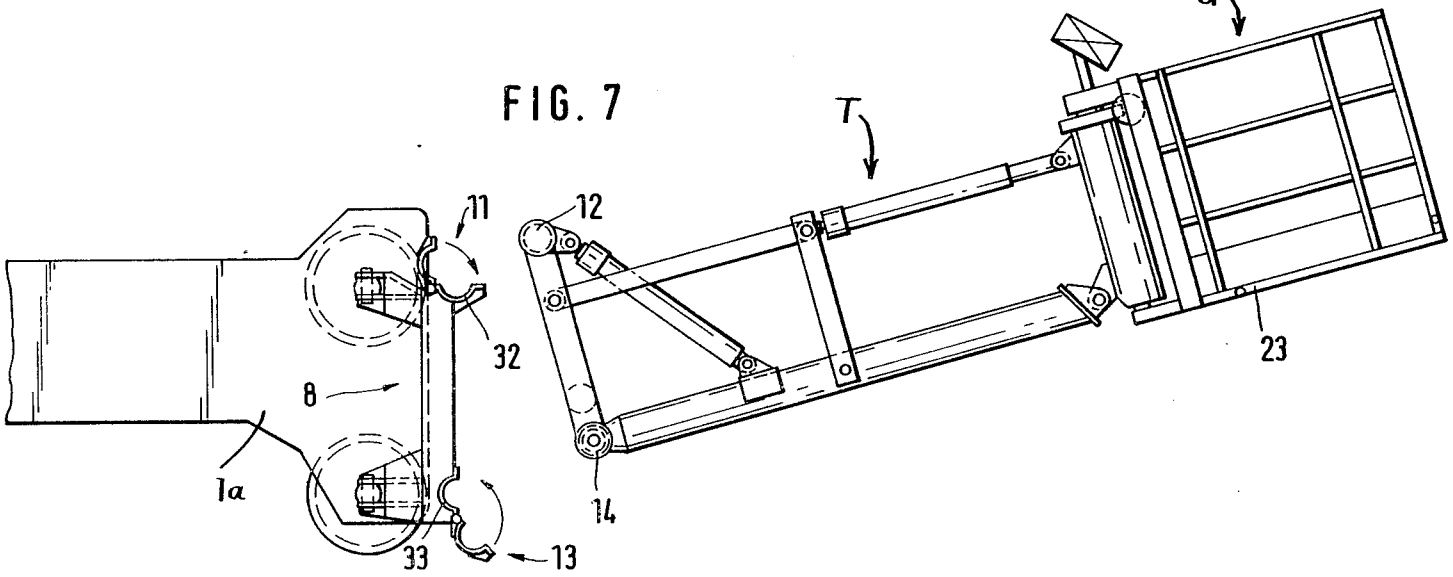
FIG. 7 illustrates the structure of FIG. 1 but with the attachment uncoupled from the end portion of the boom.

The carrier T further comprises two elongated parallel braces 16 and 17 which extend between the left-hand component 15 and a right-hand component 18 of the carrier and whose end portions are articulately connected to the respective components by horizontal pins 16*a*, 17*a*, bolts or the like. The right-hand component 18 of the carrier T defines a pivot axis 19 which is normally vertical and about which the gallery G can turn relative to the carrier and/or vice versa. The component 18 is a hollow tube which rotatably receives a vertical shaft 20 the upper and lower end portions of which are provided with lugs 21. These lugs are rigidly secured to the adjacent upright wall or railing 22 of the gallery G. The latter further comprises two spaced parallel lateral walls 24 which are pivotally secured to the respective end portions of the wall 22, an additional wall 25 which is spaced apart from and is parallel with the wall 22, and a bottom wall or floor 23 which is articulately connected to the horizontal lower marginal portions of the walls 22 and 25. The separable connections between the right-hand end portions of the walls 24 and the respective end portions of the wall 25 are indicated at 26 in FIG. 3. In order to convert the gallery G into a relatively small and compact package, the lateral walls 24 are disconnected from the wall 25 at 26 and are folded against the adjacent inner side of the wall 22 as shown in FIGS. 3 and 4. In the next step, the wall 25 is folded over the floor 23, and the floor 23 is thereupon folded upwardly to a position of substantial parallelism with the walls 22 and 24 (note FIG. 5). The hinge between the wall 25 and the floor 23 is shown at 27, and the hinge between the floor 23 and the wall 22 is shown at 28. When the gallery G is fully collapsed in a manner as shown by phantom lines in FIG. 2 and by solid lines in FIG. 6, its relatively flat sections 22, 23, 24, 24 and 25 are disposed in four neighboring planes (the two sections 24 are located in a common plane) and such planes are parallel to the pivot axis 19 which is defined by the component 18 of the carrier T. The arrangement is preferably such that, when the gallery G is fully erected as shown in FIGS. 1, 3 or 7 (the dimensions of the gallery in FIGS. 1 and 7 are different from those shown in FIG. 3), the shaft 20 is held against rotation in the component 18 of the carrier T so that the latter is located between the gallery G and the end portion 1*a* of the boom 1. When the gallery G is to be collapsed, the shaft 20 is freed for rotation about the axis 19, the sections or walls 22, 23, 24, 24 and 25 of the gallery are moved to the mutual positions shown in FIGS. 2 and 6, and the thus collapsed gallery is then pivoted through 90 degrees behind the carrier 8, as viewed in FIG. 1, before the carrier T is pivoted through 180 degrees about the axis 5 (upon removal of cotter pins 7 at one side of the end portion 1*a*) so that the carrier is adjacent to one side of the boom 1 and the collapsed gallery G is adjacent to the carrier and is also adjacent to and substantially parallel with the one side of the boom. It is clear that suitable means are provided for releasably holding the gallery G in collapsed condition, for releasably holding the carrier T at the one side of the boom 1, and for releasably holding the collapsed gallery G adjacent to the carrier T when the latter is held in the position of FIG. 6. The carrier T and the collapsed gallery G then do not extend beyond the end portion 1*a* of the boom 1 and are accommodated in an area at a level below the upper edge face of the boom 1 so that they do not contribute to the height of the machine which includes the boom. Therefore, such machine can be readily advanced from a first to a second locale of use, from a yard to a locale of use or vice versa because its space requirements (in the longitudinal direction of the boom 1 as well as vertically) are not greater than if the entire attachment including the carrier T and the gallery G were completely detached from the boom prior to transport.

The braces 16 and 17 are articulately connected to each other by a centrally located vertical cross brace 29 which stiffens the carrier T. The cross brace 29 divides the upper brace 17 into two halves of which the right-hand half 30, as viewed in FIG. 1, is of variable length. To this end, the half 30 constitutes a fluid-operated motor, such as a pneumatic or hydraulic double-acting cylinder and piston unit, which renders it possible to change the orientation of the axis 19 with reference to the axis 5 by shortening or lengthening the brace 17. In other words, an operator occupying the gallery G and actuating the appropriate control elements on a control panel CP can change the inclination of the floor 23 by changing the length of the brace 17.

The carrier T further comprises a second fluid-operated motor 31 which acts between the component 15 and the lower brace 16 and can change the inclination of the braces 16, 17 relative to the components 15, 18, i.e., the motor 31 can change the inclination of the braces 16, 17 with reference to the axes 5 and 19. This results in lowering or lifting of the gallery G with reference to the end portion 1*a* of the boom 1. By manipulating the controls for the motors 30 and 31 (while the length of the boom 1 is preferably reduced to a minimum), an operator can maintain the floor 23 in a horizontal plane and can lower the floor all the way to the level of the ground. This enables the worker or workers to conveniently enter or leave the gallery G. The controls for the motors 30 and 31 are also actuatable from the cabin of the machine including the boom 1.

FIG. 7 shows that the lower jaws 32 of the two upper pairs 11 of jaws are rigidly secured to the upper portion of the tubular member 10, and that the upper jaws 33 of the lower pairs 13 of jaws are also rigidly secured to the lower portion of the member 10. Such mounting of the jaws of the upper pairs 11 and lower pairs 13 simplifies coupling of the carrier T to and its uncoupling from the end portion 1*a* of the boom 1. Thus, when the end portions of the upper crossbar 12 are properly inserted into the rigidly mounted lower jaws 32 of the upper pairs 11, the end portions of the lower crossbar 14 can automatically enter the fixed jaws 33 of the lower pairs 13. The pivotable jaws are thereupon moved to their closed positions and are locked in such closed positions to ensure that the carrier T is safely coupled to the end portion 1*a*. The just mentioned mounting of the carrier T on the end portion 1*a* of the boom 1 preferably involves slight tilting of the carrier in a manner as shown in FIG. 7 so that, when the crossbar 12 enters the fixed jaws 32, the carrier can pivot clockwise by gravity to introduce the crossbar 14 into the fixed jaws 33 of the two lower pairs 13 of jaws. The means for releasably locking the mobile jaws to the respective fixedly mounted jaws 32 and 33 can comprise bolts, screws or other types of fasteners, not specifically shown.

Figure 11:
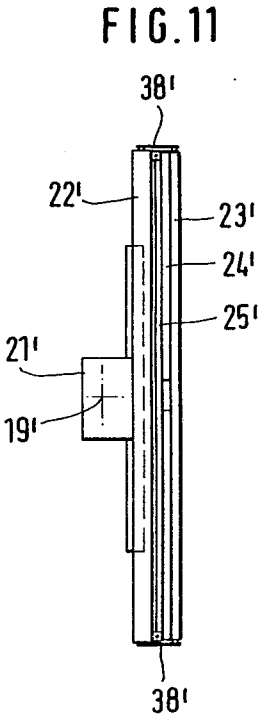
FIG. 11 is a plan view of the fully collapsed gallery of FIGS. 8 to 10.
Figure 9:
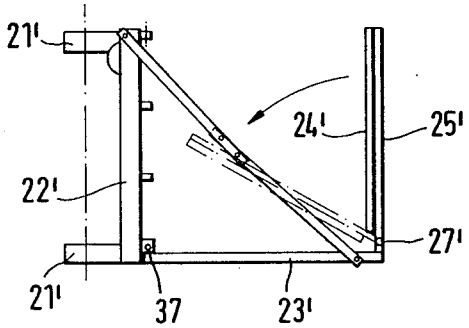
FIG. 9 is a side elevational view of the modified gallery and shows a first stage of converting such gallery into a compact package.
Figure 10:
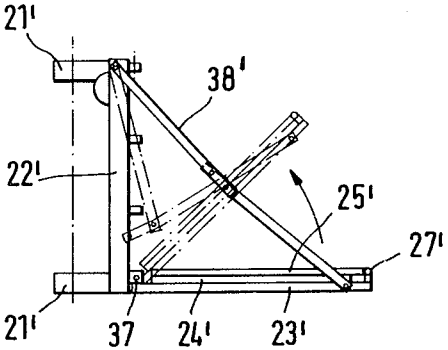
FIG. 10 is a similar side elevational view and illustrates a further stage of conversion of the gallery of FIG. 8 into a compact package.
Figure 8:
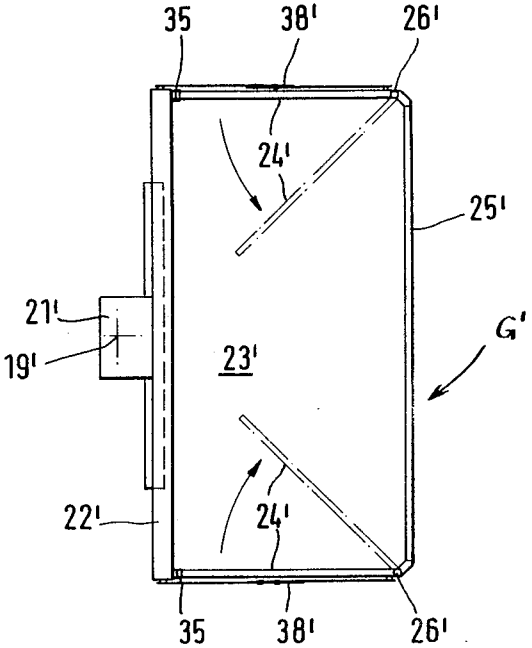
FIG. 8 is a plan view of a modified gallery.

FIGS. 8 to 11 illustrate a modified gallery G′ wherein all such parts which are identical with or clearly analogous to those of the gallery G are denoted by similar reference characters each followed by a prime. The walls or railings 24′ are detachably secured to the respective end portions of the wall 22′ at 35 and are pivotally secured to the respective end portions of the wall 25′ by hinges 26′. The floor 23′ is pivotally secured to the lower marginal portion of the wall 22′ by a hinge 37, and the lower marginal portion of the wall 25′ is pivotally secured to the floor 23′ by a hinge 27′. The connections 35 can constitute cotter pins which are insertable into registering bores or holes of the wall 22′ and of the respective walls 24′ in erected condition of the gallery G′. When the gallery G′ is to be collapsed, the pins 35 are removed and the walls 24′ are pivoted at 26′ against the inner side of the wall 25′ before the latter is pivoted at 27′ against the upper side of the floor 23′. The pivot means 26′ are slightly offset from the general plane of the wall 25′ (see FIG. 8) to thus permit the walls 24′ to move into a common plane next to the inner side of the wall 25′. In other words, the inner sides of the walls 24′ can abut against or come close to abutment with the inner side of the wall 25′ before the latter is pivoted toward the upper side of the floor 23′. The outer sides of the folded walls 24′ then abut against the upper side of the floor 23′ while the inner sides of the walls 24′ abut against the inner side of the folded wall 25′. In the next step, the floor 23′ is pivoted at 37 through an angle of approximately 90° so that it moves to a position of parallelism with the wall 22′, and the walls 24′, 24′, 25′ are then disposed between the floor 23′ and the wall 22′. The hinges 37 are slightly offset with reference to the inner side of the wall 22′ so as to ensure that the gallery G′ can be collapsed into a relatively thin (flat) package as shown in FIG. 11.

The gallery G′ further comprises stiffening braces 38′ each of which includes two pivotally connected halves and each of which is articulately connected to the upper portion of the wall 22′ as well as to that portion of the floor 23′ which is remotest from the wall 22′ in erected condition of the gallery G′. The braces 38′ are folded during collapsing of the gallery G′ and do not contribute to the bulk (thickness) of the fully collapsed gallery (note FIG. 11). It will be seen that the stiffening braces 38′ are outwardly adjacent to the respective walls 24′.

An advantage of the gallery G′ that it can be collapsed into a surprisingly small and thin package which can be moved to a position of parallelism with one side of the boom 1 in the same way as described in connection with FIGS. 1 to 7. Compactness of the gallery G′ in collapsed condition is attributable to the aforediscussed selection of locations of hinges 26′, pins 35 and hinge 27′ with reference to the walls 25′, 22′ and floor 23′, i.e., such parts allow the walls and the floor of the collapsed gallery G′ to actually touch one another and to thus contribute to a further reduction of the thickness of the resulting flat package.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An attachment for the end portion of an elongated boom in a crane or an analogous machine wherein the boom is movable between a plurality of positions and/or can be caused to change its length, comprising a carrier having a first and a second end portion; means for coupling said first end portion to the end portion of the boom so that the carrier is pivotable about a first axis, which is at least substantially normal to the longitudinal direction of the boom, to and from a predetermined position of at least substantial parallelism with and adjacent to one side of the boom; a collapsible gallery; and means for connecting the gallery to said second end portion for pivotal movement about a second axis which is at least substantially parallel to said first axis so that the gallery is movable to a position in which it is adjacent to said one side of the boom.

2. The attachment of claim 1, wherein the boom is arranged to move in a substantially vertical plane and said first axis is disposed in or is parallel with said plane.

3. The attachment of claim 1, wherein said gallery comprises a plurality of relatively flat sections movable with reference to each other into a plurality of neighboring planes which are substantially parallel to each other, said neighboring planes being at least substantially parallel to the longitudinal direction of the boom in collapsed condition of the gallery.

4. The attachment of claim 1, wherein said gallery includes a plurality of substantially flat sections which are movable with reference to each other into a plurality of neighboring planes, said sections including a floor and a plurality of railings extending above the floor in the non-collapsed condition of the gallery.

5. The attachment of claim 4, wherein said neighboring planes are parallel to said second axis.

6. The attachment of claim 1, wherein said carrier comprises spaced-apart first and second components respectively adjacent to and extending in substantial parallelism with said first and second axes, and two substantially parallel elongated braces extending between said first and second components, each of said braces having a first and a second end portion articulately connected with the respective component and further comprising means for changing the inclination of said braces with reference to said axes.

7. The attachment of claim 6, wherein said adjusting means comprises fluid-operated motor means.

8. The attachment of claim 6, wherein at least one of said braces is of adjustable length so that changes in the length of said one brace entail a change in the orientation of one of said axes with reference to the other of said axes.

9. The attachment of claim 1, wherein said gallery comprises a floor and four walls normally extending above said floor.

10. The attachment of claim 9, wherein said walls include a first wall connected to said carrier, a second wall spaced apart from said first wall, and parallel third and fourth walls extending between said first and second walls in non-collapsed condition of the gallery.

11. The attachment of claim 10, wherein said first and second walls are at least substantially parallel to each other and said third and fourth walls extend at right angles to the first and second walls in the non-collapsed condition of said gallery.

12. The attachment of claim 10, further comprising means for detachably connecting said third and fourth walls to one of said first and second walls, said third and fourth walls being pivotable against the other of said first and second walls upon detachment from said one wall.

13. The attachment of claim 12, wherein said floor is pivotable with reference to said first wall to a position of parallelism with the first wall so that the second, third and fourth walls of the collapsed gallery are disposed between said first wall and said floor.

14. The attachment of claim 12, wherein said first wall has a lower marginal portion and said floor is pivotally secured to said lower marginal portion, said second wall having a lower marginal portion pivotally secured to said floor.

15. The attachment of claim 1, wherein said first axis is disposed at said one side of the boom.

16. The attachment of claim 1, further comprising means for releasably locking said carrier against pivotal movement about said first axis.

17. The attachment of claim 1, further comprising means for releasably securing said carrier to the boom.

18. The attachment of claim 1, wherein said carrier comprises means for changing the orientation of one of said axes with reference to the other of said axes.

19. The attachment of claim 1, further comprising means for changing the level of said gallery with reference to the end portion of the boom through the medium of said carrier.

20. The attachment of claim 1, further comprising means for detachably securing said gallery to said carrier.

* * * * *